US006875162B2

(12) United States Patent
Barksdale et al.

(10) Patent No.: US 6,875,162 B2
(45) Date of Patent: Apr. 5, 2005

(54) STAND-UP ROLLER APPARATUS

(75) Inventors: Daniel Leon Barksdale, Brownsburg, IN (US); William Albert Wasitis, Indianapolis, IN (US)

(73) Assignee: BFS Diversified Products, LLC, Indianapolis, IN (US)

( * ) Notice: Subject to any disclaimer, the term of this patent is extended or adjusted under 35 U.S.C. 154(b) by 0 days.

(21) Appl. No.: 10/183,304

(22) Filed: Jun. 27, 2002

(65) Prior Publication Data

US 2004/0002414 A1 Jan. 1, 2004

(51) Int. Cl.[7] ..... B05C 1/08
(52) U.S. Cl. ..... 492/19; 492/13
(58) Field of Search ..... 492/13, 19, 17; 15/230.11; 404/122, 124, 131; 52/749.12, 746.11

(56) References Cited

U.S. PATENT DOCUMENTS 508,157 A * 11/1893 Wilson ..... 404/131
606,687 A * 7/1898 Seymour ..... 404/131
1,302,275 A * 4/1919 Ashmore et al. ..... 404/124
1,924,644 A * 8/1933 Himmelberger ..... 404/131
3,082,459 A * 3/1963 Johnson ..... 15/230.11
3,910,738 A * 10/1975 Chandler et al. ..... 404/124
4,128,909 A * 12/1978 Kawabe et al. ..... 15/104.002
4,548,016 A * 10/1985 Dubich et al. ..... 52/749.12
4,958,400 A * 9/1990 Sugita ..... 15/79.1
5,242,362 A * 9/1993 Talamantez ..... 492/13
5,393,289 A 2/1995 Green
5,846,176 A * 12/1998 Zieger et al. ..... 492/13
6,135,934 A * 10/2000 Couch ..... 492/13

OTHER PUBLICATIONS

Everhard Catalog—"Roofing Tools" 2 pages plus pricing sheet (Jul. 14, 1986).

* cited by examiner

*Primary Examiner*—David P. Bryant
*Assistant Examiner*—Marc Jimenez
(74) *Attorney, Agent, or Firm*—Arthur M. Reginelli

(57) ABSTRACT

Stand-up roller apparatus (20) for applying a uniform pressure to roofing membranes during installation on roofs according to the present invention comprises an elongated handle (21); a bracket (22) carried at one end of the handle; a roller assembly (23), rotatably affixed to the bracket and providing a sleeve, directly engageable with a roofing membrane being applied, wherein the dead weight of the apparatus is sufficient to join the applied roofing membrane to a mating surface on the roof without the application of additional downward force by the operator.

18 Claims, 7 Drawing Sheets

STAND-UP ROLLER APPARATUS

BACKGROUND OF THE INVENTION

This invention relates to apparatus for forming field seams in single ply roofing membranes. When installing a roof on a flat roof building, roof membranes are applied over a base structure, which is typically a concrete substrate, covered by an insulation board. Roof membranes, which are made of polymeric materials, such as ethylene propylene diene monomer (EPDM), repel water and snow and generally protect the integrity of the underlying structure. Use of EPDM membranes is preferred because, being unsaturated, degradation due to sunlight and ozone is greatly diminished.

It is necessary to secure the membrane to the roof to prevent movement as well as actual lifting when high winds pass over the roof. In some installations roofing membranes are held down on the roof with a layer of river rock. Because this adds considerably to the weight of the roof, another method of securement is by the use of an adhesive. Mechanical fasteners are not suitable because their use would perforate the membrane, creating a breach in the integrity and seal of the roof. One method of application utilizes fasteners that pass through a narrow width of a scrim reinforced membrane, through the insulation and into the concrete or other substrate. The latter membrane is applied to the roof in strips across the roof at periodic intervals, on the order of eight feet (2.4 M). Then the single ply roofing membrane is applied to these strips with the use of adhesive, thereby securing the roofing membrane to the roof at eight foot (2.4 M) intervals.

The roofing membranes are typically manufactured in wide sheets, on the order of 10 to 50 feet (3 to 15 M) wide and are produced in lengths sufficient to cover the length or width dimension of a building roof without splicing. Where a dimension, such as the width, exceeds the width of the membrane, successive sheets are spliced together. Seams, when necessary, must also ensure weatherability and watertightness of the roof. In both instances, splicing and joining the overlying membrane to the strips, it is necessary to adhere overlapping sheets together, in the case of splicing, and to adhere the single ply membrane to the strip in the latter instance. This is done by the application of an adhesive, in the form of a liquid or tape containing a pressure-sensitive adhesive, to the mating surfaces, and then applying pressure to the mating surfaces to obtain adhesion, typically by rolling the surfaces.

At present, the two types of joints are made with the aid of a hand roller, operated by a worker, on his hands and knees, moving the roller in a back and forth motion over a small area and progressing forward to the edge of the roof. In addition to the labor involved, the seaming is not always uniform due to differences in application forces from worker to worker as well as the fatigue of the worker after prolonged seaming. An apparatus that minimizes fatigue and ensures a more uniform application force is desired.

BRIEF SUMMARY OF THE INVENTION

Briefly, the present invention provides a stand-up roller apparatus for use in attaching single ply roofing membranes to the adhesive strips as well as for forming field seams. A method for the use of such apparatus in the installation of roofing membranes is also provided.

In general, stand-up roller apparatus for applying a uniform pressure to roofing membranes during installation on roofs according to the present invention comprises an elongated handle; a bracket carried at one end of the handle; a roller assembly, rotatably affixed to the bracket and providing a sleeve, directly engageable with a roofing membrane being applied, wherein the dead weight of the apparatus is sufficient to join the applied roofing membrane to a mating surface on the roof without the application of additional downward force by the operator.

The method for the application of roofing membranes to prepared roofs according to the present invention includes the steps of affixing membrane fastening strips to a roof at periodic intervals with respect to one dimension of the roof; applying a roofing membrane onto the roof and over a plurality of the fastening strips in successive fashion; combining at least a portion of the fastening strips and a mating portion of the membrane with an adhesive material; and, applying a uniform pressure over the membrane and successive fastening strips whereby the adhesive material adheres the mating surfaces together. The uniform pressure is applied via the stand-up roller apparatus of the present invention, which by virtue of its design and weight, ensures the same application of force over each fastening strip.

The method for seaming adjacent sheets of roofing membranes on roofs according to the present invention includes the steps of applying a sheet of roofing membrane onto the roof, allowing a seam portion thereof to overlap with a mating seam portion of a previously laid sheet of roofing membrane; combining the mating seam portions of the membrane with an adhesive material; and, applying a uniform pressure over the mating seam portions of roofing membrane, whereby the adhesive material adheres the mating surfaces together. The uniform pressure is applied via the stand-up roller apparatus of the present invention, which by virtue of its design and weight, ensures the same application of force over each seam.

At least one or more of the foregoing aspects, together with the advantages thereof over the known art relating to seaming apparatus and methods for the installation of roofing membranes, which shall become apparent from the specification which follows, are accomplished by the invention as hereinafter described and claimed.

DETAILED DESCRIPTION OF THE INVENTION

Figure 2:
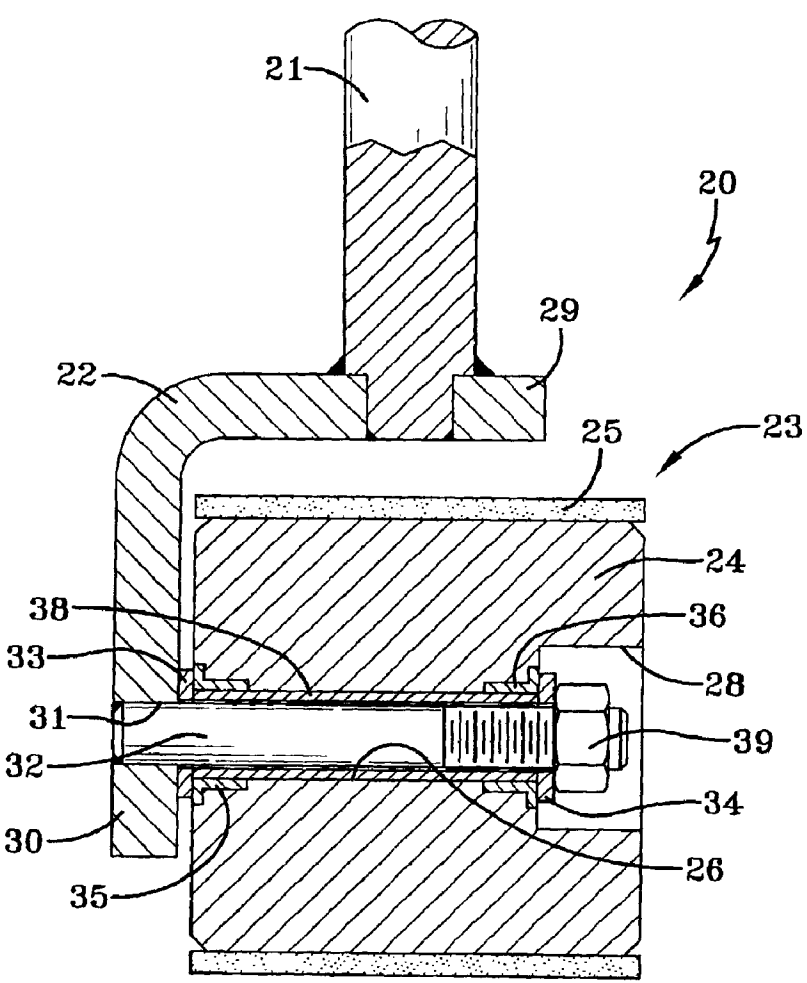
FIG. 2 is a side elevation, in cross-section, depicting the roller and its relation to the handle of the apparatus.
Figure 1:
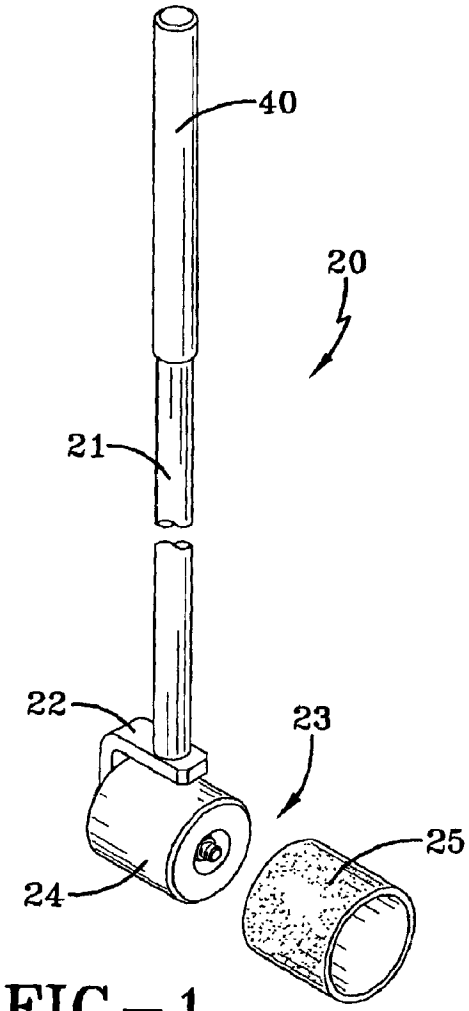
FIG. 1 is a perspective view of the stand-up roller apparatus of the present invention, depicting a removable sleeve.
Figure 3:
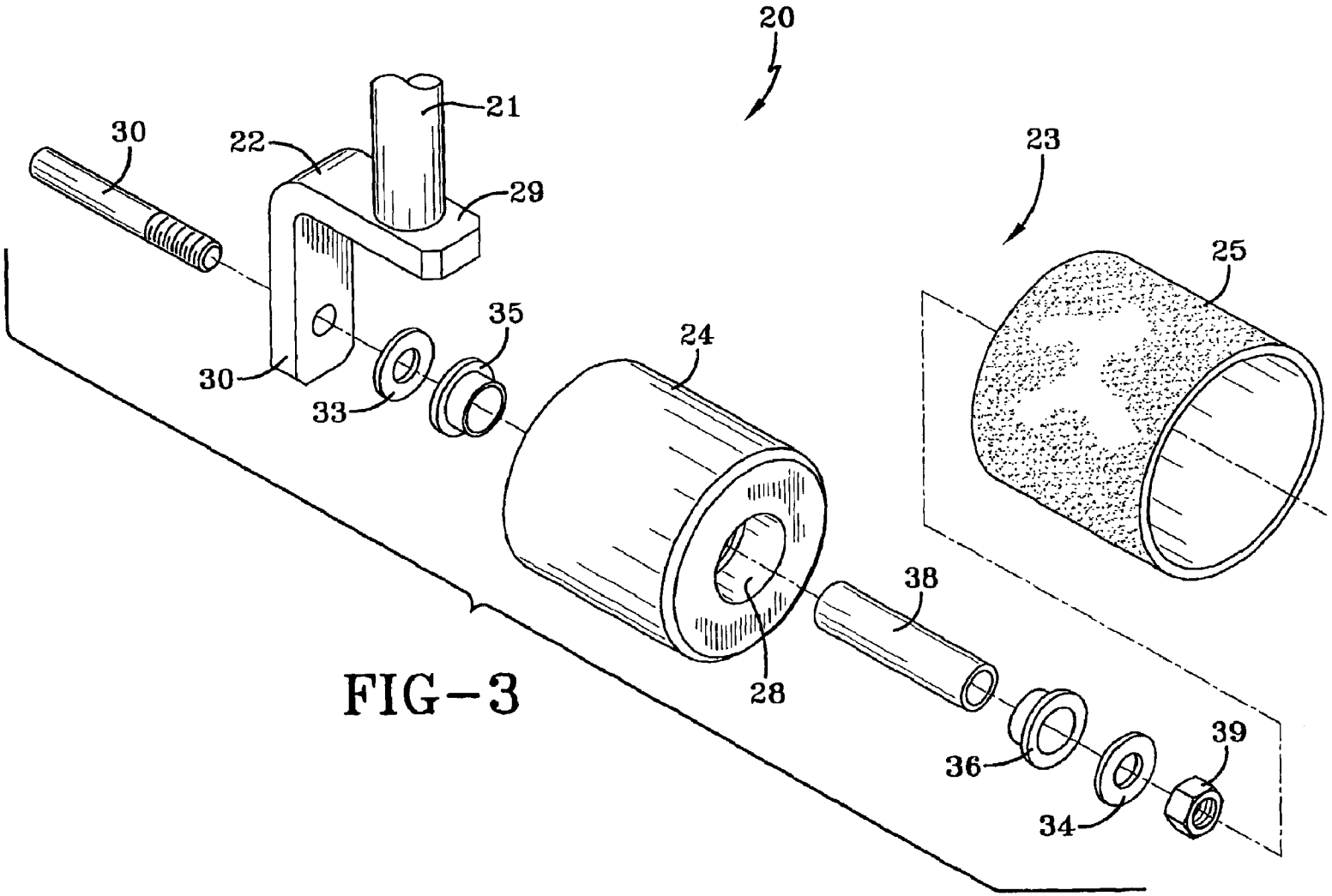
FIG. 3 is an exploded view, depicting the stand-up roller and its relation to the handle of the apparatus.
Figure 4:
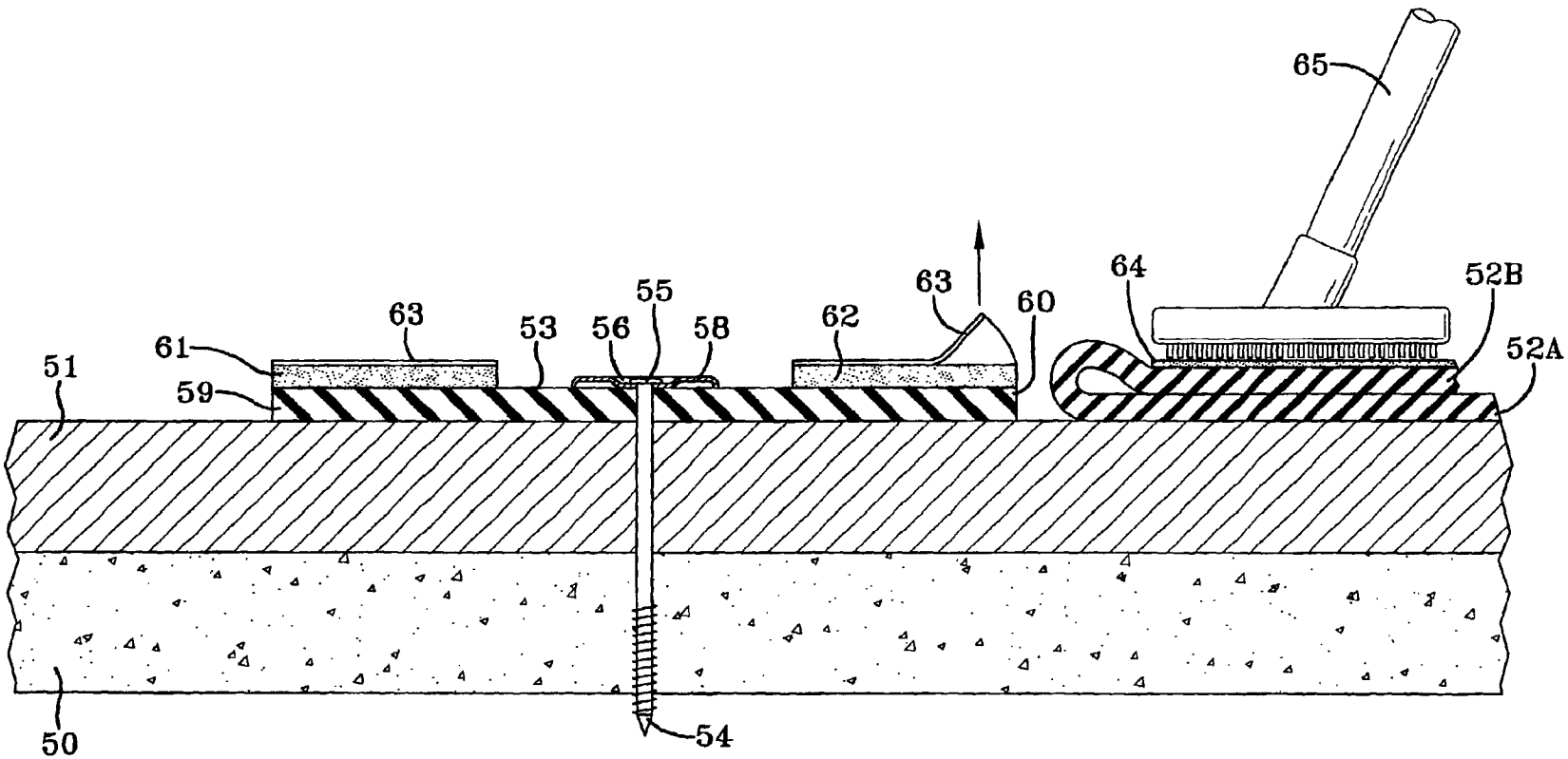
FIG. 4 is a side elevation, of a portion of a roof, in cross-section, depicting the substrate, insulation, fastening strip and single ply membrane being coated with an adhesive.

With reference to FIGS. 1–3, the stand-up roller apparatus of the present invention is designated generally by the numeral 20. The apparatus 20 includes a handle 21, a mounting bracket 22 and a roller assembly, indicated by the numeral 23. The roller assembly 23 includes a steel roller 24, and a replaceable sleeve 25, which fits over the roller as best depicted in FIG. 2.

The roller 24 is essentially in the form of a cylinder having a central aperture 26 passing therethrough concentric with its axis. The outboard end of cylindrical roller 24 is provided with a larger aperture 28, which is also concentric with the longitudinal axis. The diameter of the roller is about 3.75 inches (9.5 cm), but is not limited thereto.

The bracket 22 is an L-shaped member, the shorter, horizontal arm 29 of which is affixed to the base of the handle 21 as by welding or other suitable means. The vertical arm 30 of bracket 22 is provided with an aperture 31, into which a threaded stud 32 is either permanently affixed as by a press fit or welding or, in the alternative, a bolt (not shown) may be employed. The assembly of the roller 24 onto the stud 32 is best depicted in FIG. 3 and includes the use of inboard and outboard washers 33, 34 respectively, inboard and outboard bushings 35, 36 respectively, an internal sleeve 38 which fits within aperture 26 and a nut 39, engagable with the threaded end of stud 32 and housed within the outboard aperture 28 of the roller 24.

The handle 21 is preferably, but not necessarily, of solid metal construction and can provide a rubber sleeve 40 to provide a better, more comfortable grip. The overall length of the handle 21 is such that the worker may apply the roller 24 to the surface of the membrane from an upright position and therefore includes both straight and bent configurations. The length of the handle allows the worker to use the roller apparatus in a standing, upright position, which eliminates fatigue encountered by the use of shorter handled roller apparatus. The weight of the roller apparatus 20 can be from about 20 to 30 pounds (9.1 to 13.6 Kg) and is preferably approximately 22 pounds (9.9 Kg). The diameter of the roller apparatus 20 is preferably 3.75 inches (9.5 cm). This weight, along with the length of the handle, ensures the application of a uniform force or pressure along the roofing membrane during the installation thereof. Moving the roller 24 along 2 to 3 feet (0.6 to 0.9M sections of the area being joined, will permit the application of a generally uniform amount of pressure. The application of approximately 15 to 16 pounds (6.8 to 7.3 Kg) of pressure is adequate to provide good sheer and peel adhesion.

The cylindrical sleeve 25 provides a soft interface between the body of the steel roller 24 and the roofing membrane. The sleeve is preferably manufactured from rubber or other elastomeric material and is intended to have a durometer that is less than that of the membrane. Typically roofing membranes have a Shore A durometer of about 60 to 65. The sleeve is generally cylindrical and frictionally engages the roller 24 or may be adhered to it.

With reference next to FIGS. 4–9, the use of the apparatus 20 for the installation of roofing membranes will be described. The roof typically provides a concrete substrate, indicated by the numeral 50, which itself rests on steel substructure, not shown. It is customary to provide an insulation board 51 over the concrete substrate and roofing membrane 52 is applied thereover. As explained hereinabove, the roofing membrane 52 is a single ply component manufactured from EPDM or other suitable material, and is typically produced in wide widths and long lengths. As such, a roll of the material is transported to the roof of a building and then rolled out over the insulation by several workers to provide an outer covering. At periodic intervals, e.g. 8 feet (2.4 M), strips of reinforced membrane, indicated by the numeral 53, are applied in parallel arrangement. The reinforced strips 53 are applied to the roof with suitable fasteners 54 which comprise a screw or nail 54, embedded in the concrete layer 50. The fastener 54 carries a head 55 which resides in the recess 56 of a larger washer 58.

To the extent possible, the reinforced membrane 53 is applied perpendicularly to the length of the roll of single ply membrane 52. The reinforced membrane 53 is approximately 10 inches (25.4 cm) wide and is provided along its opposed edges 59 and 60 with pressure sensitive adhesive strips 61, 62 respectively which are approximately 3 inches (7.6 cm) wide and are covered with a release paper 63. The construction and use of the reinforced strips 53 is well known in the industry and does not constitute a limitation on the practice of the present invention. Accordingly, it is to be appreciated that other forms of fastening strips may be employed with the present invention.

Figure 5:
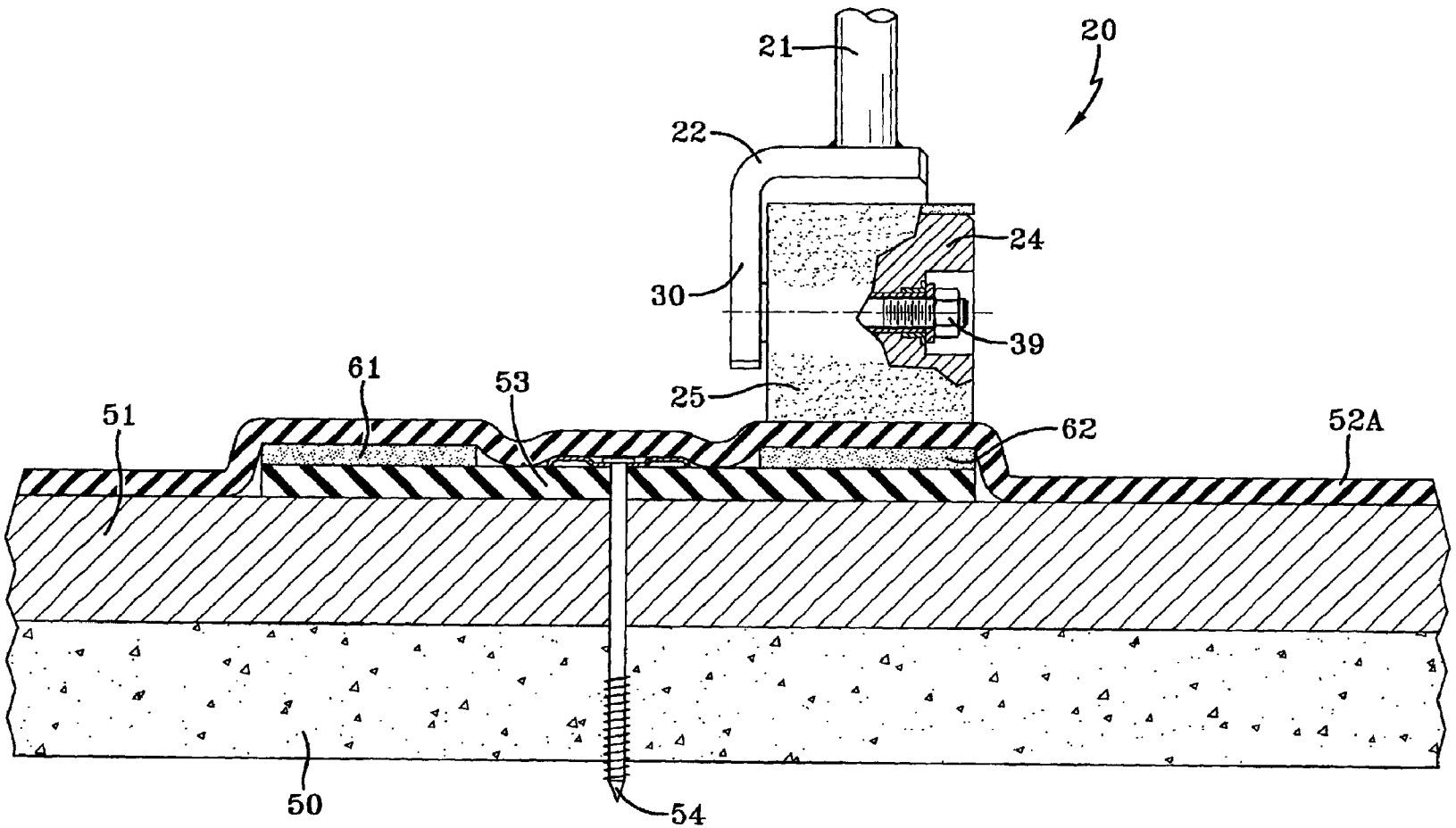
FIG. 5 is a side elevation, similar to FIG. 4, in which the single ply membrane is being seamed with the stand-up roller of the present invention.
Figure 6:
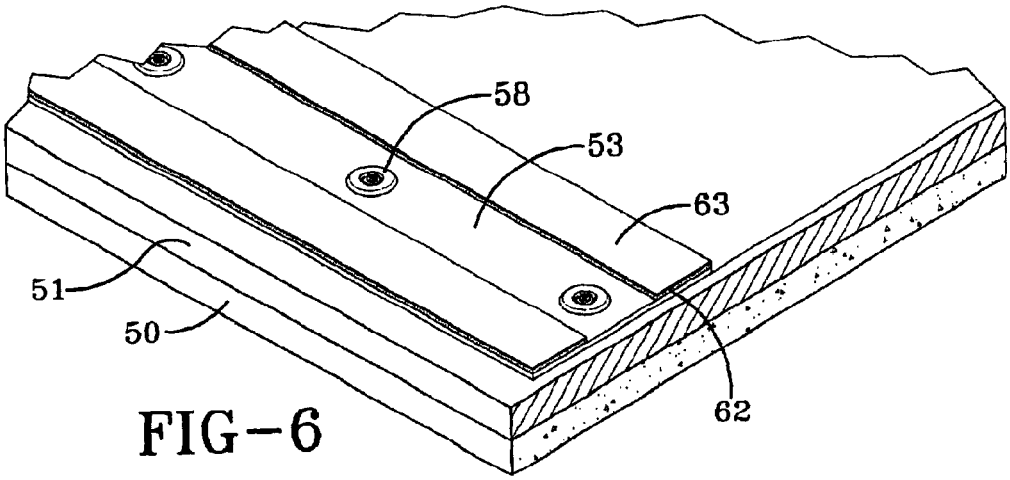
FIG. 6 is a perspective view, depicting the substrate, insulation and fastening strip carrying adhesive tape, prior to the application of the membrane.
Figure 7:
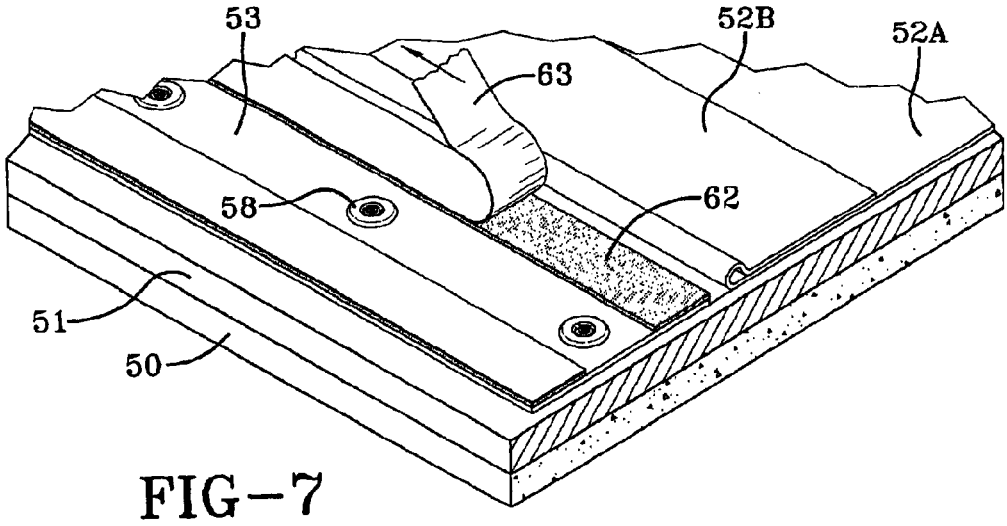
FIG. 7 is a perspective view, similar to FIG. 6, depicting the removal of release paper from the adhesive tape, prior to the application of the membrane.
Figure 8:
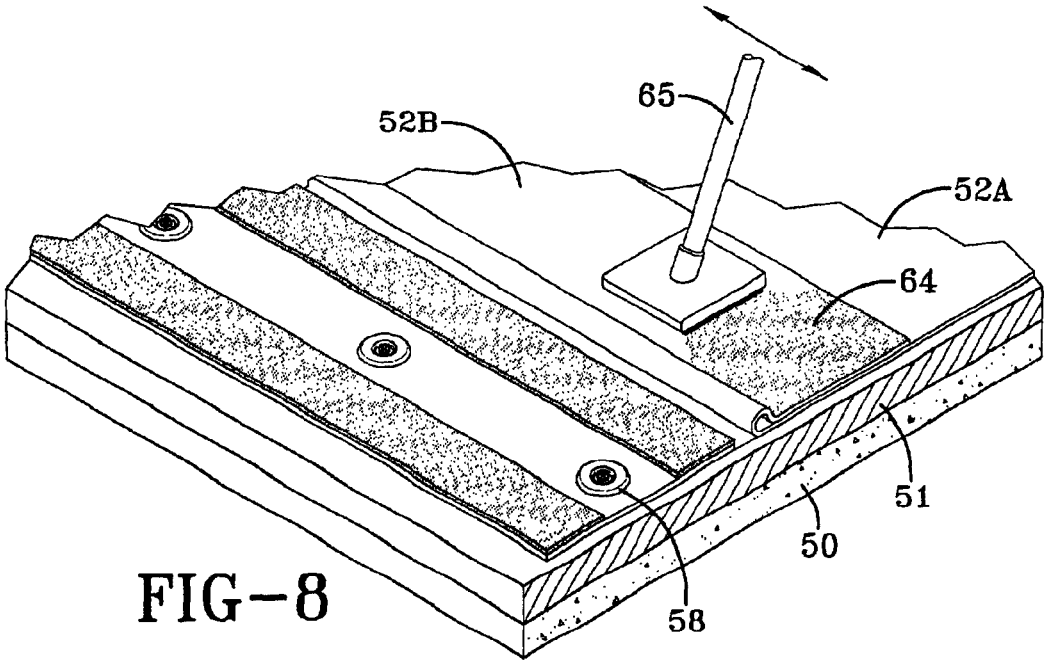
FIG. 8 is a perspective view, similar to FIG. 7, depicting the application of a liquid adhesive to the membrane.
Figure 9:
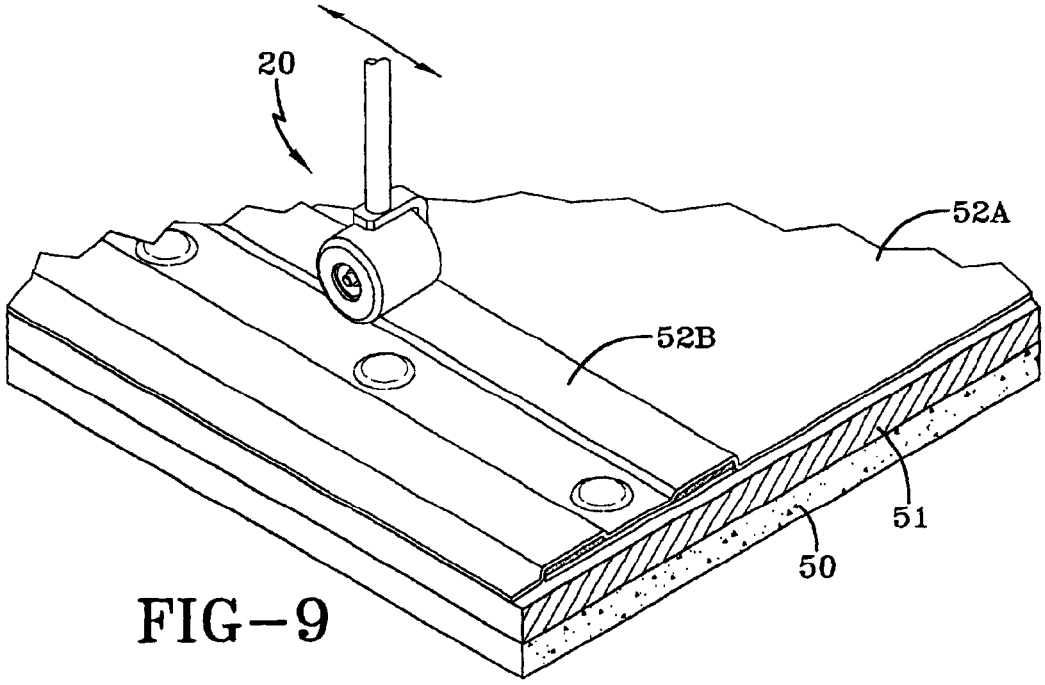
FIG. 9 is a perspective view, similar to FIG. 8, depicting the application of the stand-up roller to the membrane.

Returning to FIGS. 4 and 8, for the installation of the single ply membrane 52, a section of the membrane 52A is laid on the insulation 51 while the remainder of the membrane, 52B, has been rolled back on itself (52A). The worker then applies a liquid based or other suitable adhesive layer 64 to the surface 52B with a suitable tool 65. After the application of the adhesive coating 64, the release papers 63 are removed, (FIG. 7) and the roofing membrane 52 is rolled over the fastening strip 53 as depicted in FIGS. 5 and 9. The adhesive coating 64 assists in the adhesion of the membrane 52 to the pressure sensitive adhesive tapes 61 and 62 as well as the other surfaces of the strip 53 and washer 58 with which it makes contact. The next step is for the worker to apply the stand up roller apparatus 20 to the membrane 52, applying force to both adhesive tapes 61 and 62, as depicted in FIGS. 5 and 9. Preferred practice is to begin rolling at approximately the middle of the strip and proceed toward the edges, thereby driving out any excess air that may be entrapped. As stated hereinabove, the apparatus 20 provides the necessary weight to effect a positive attachment of the membrane to the adhesive strips carried by the reinforced membrane strips, as well as a positive seaming between adjacent sheets of roofing membrane. The vertical component force provided by the apparatus 20 is sufficient to mate the adjoining surfaces in both instances.

The method for the application of roofing membranes to prepared roofs according to the present invention includes the steps of affixing membrane fastening strips to roof at periodic intervals with respect to one dimension of the roof; applying a roofing membrane onto the roof and over a plurality of the fastening strips in successive fashion; combining at least a portion of the fastening strips and a mating portion of the membrane with an adhesive material; and, applying a uniform pressure over the membrane and successive fastening strips whereby the adhesive material adheres the mating surfaces together. The uniform pressure is applied via the stand-up roller apparatus of the present invention, which by virtue of its design and weight, ensures the same application of force over each fastening strip.

Figure 10:
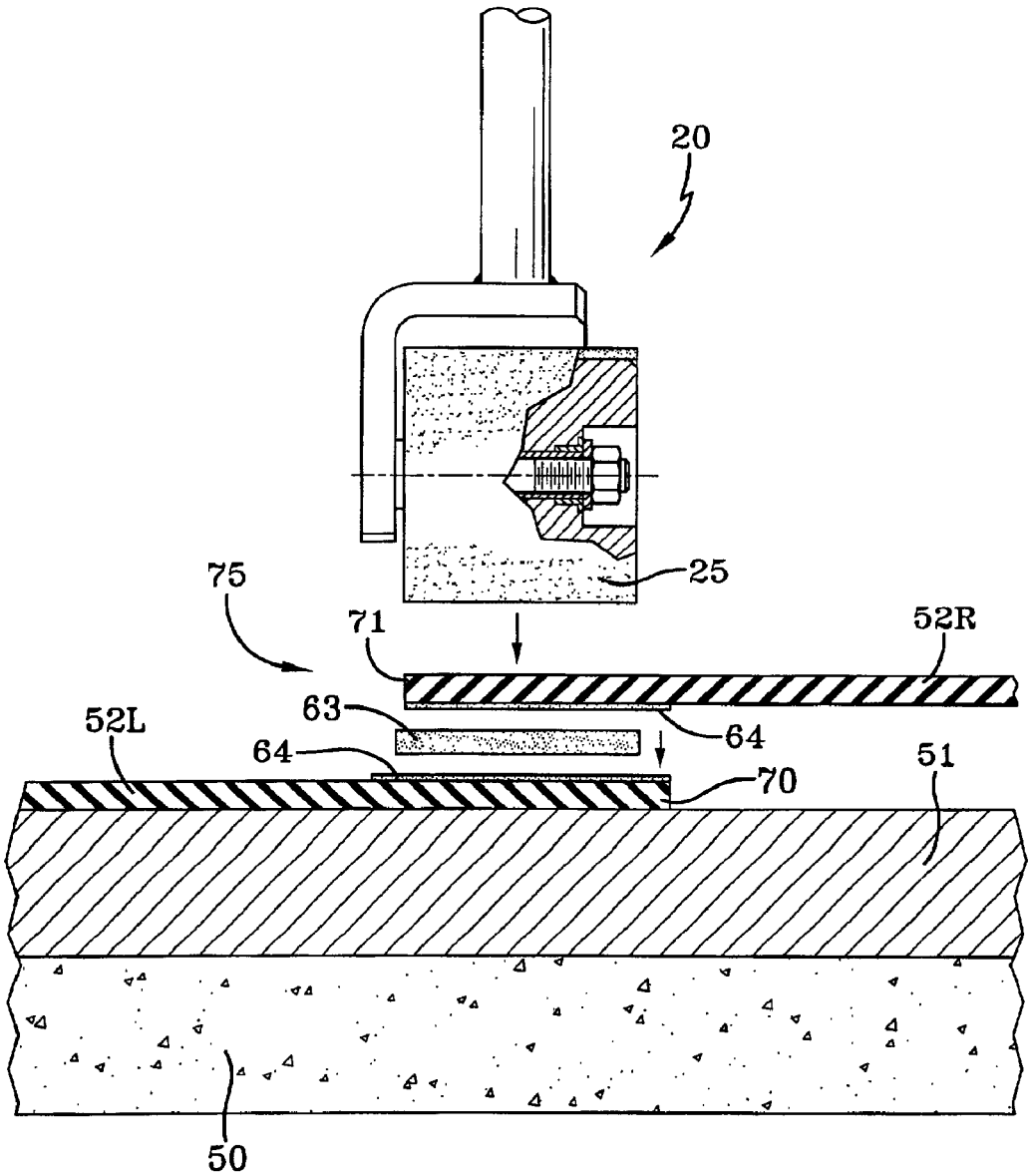
FIG. 10 is a side elevation, of a portion of a roof, in cross-section, depicting the substrate, insulation and seaming of adjacent edges of single ply membrane with an adhesive and application of the stand-up roller.

With reference to FIG. 10, the seaming of adjacent sheet of roofing membrane 52 will be described next. Again, the roof of the structure may include the concrete substrate 50 and overlying insulation board 51. In the drawing, one sheet of roofing membrane 52L has been extended onto the board 51 and terminates with the lateral edge 70. To effect a seam, another sheet of roofing membrane 52R has been positioned over the insulation board in an overlapping manner in relation to the sheet 52L, so that the lateral edge 71 of membrane 52R overlaps 52L to meet the requirements of the architect and relevant building codes, if any. Typically, the area extends a width of about three to six inches (7.6 to 15.2 cm) and the length of the adjoining membrane sheets. FIG. 10 has been exploded to depict the pre-seaming application of an adhesive coating 64 to mating surfaces of membrane sheets 52L and 52R. Interposed between the coating layers 64 is a pressure sensitive adhesive strip 63, which may be slightly narrower than the width of coating layers 64. After this preparation, the membrane 52R is laid over the board 51 and membrane 52L to form a seam, indicated generally by the numeral 75, which is completed by the application of force via the apparatus 20 as described hereinabove.

The method for seaming adjacent sheets of roofing membranes on roofs according to the present invention includes the steps of applying a sheet of roofing membrane onto the roof, allowing a seam portion thereof to overlap with a mating seam portion of a previously laid sheet of roofing membrane; combining the mating seam portions of the membrane with an adhesive material; and, applying a uniform pressure over the mating seam portions of roofing membrane, whereby the adhesive material adheres the mating surfaces together. The uniform pressure is applied via the stand-up roller apparatus of the present invention, which by virtue of its design and weight, ensures the same application of force over each seam.

Thus, it should be evident that the stand-up roller apparatus and method of the present invention are highly effective in the application of roofing membranes to roofs and the seaming of adjacent, overlapping membranes. The apparatus is fitted with a soft sleeve of a certain Shore A durometer hardness to follow the seam areas, thus assuring intimate contact between mating surfaces. The stand-up roller apparatus does not require the operator to apply additional force to the handle, i.e., bearing down, as is the case with existing, handle-held rollers. The force applied by the dead weight of the roller is sufficient for uniform mating and seaming. The invention is particularly suited for application of single ply EPDM membranes, but is necessarily limited thereto.

Based upon the foregoing disclosure, it should now be apparent that the use of the apparatus described herein will carry out the advantages over existing apparatus. It is, therefore, to be understood that any variations evident fall within the scope of the claimed invention and thus, the selection of specific component elements can be determined without departing from the spirit of the invention herein disclosed and described. In particular, application of roofing membranes according to the present invention is not necessarily limited to the use of single ply roofing membranes or to the use of reinforced fastening strips, carrying one or more strips of adhesive material. Thus, the scope of the invention shall include all modifications and variations that may fall within the scope of the attached claims.

What is claimed is:

1. A roller apparatus comprising:

a handle;

a bracket attached to said handle; and a roller assembly rotatably affixed to said bracket, where said roller assembly includes a roller and a replaceable rubber sleeve, where said sleeve is characterized by a Shore A durometer of less than about 60, and where the roller apparatus is characterized by a weight of about 20 to about 30 pounds.

2. The apparatus of claim 1, where said roller comprises steel.

3. The apparatus of claim 1, where said roller includes a cylindrical body, and where said rubber sleeve is positioned concentrically around said cylindrical body.

4. The apparatus of claim 1, where said rubber sleeve contacts said roller around the entire circumference of said cylindrical body of said roller.

5. The apparatus of claim 1, where said roller assembly includes an axle having inboard and outboard ends, where said inboard end is affixed to said bracket, and where said outboard end is adapted to receive a fastener assembly.

6. The apparatus of claim 5, where said outboard end includes a threaded portion and said fastener assembly includes a nut.

7. The apparatus of claim 6, where said fastener assembly includes a nut and a washer.

8. The apparatus of claim 5, where said roller includes an aperture extending axially through the center of said cylindrical body.

9. The apparatus of claim 8, where said roller is positioned concentrically around said axle and is axially secured into position by direct engagement of said fastener assembly, which is mated to said second end of said axle.

10. The apparatus of claim 9, where said outboard end includes a threaded portion and said fastener assembly includes a nut.

11. The apparatus of claim 10, where said fastener assembly includes a nut and a washer.

12. The apparatus of claim 1, where said roller assembly further includes an axle sleeve, and where said sleeve includes a cylindrical body and an aperture extending axially through the center of said cylindrical body.

13. The apparatus of claim 12, where said axle sleeve is positioned concentrically around said axle.

14. The apparatus of claim 1, where said axle sleeve contacts said axle around the entire circumference of said axle, and where said roller contacts said axle sleeve around the entire circumference of said sleeve.

15. The apparatus of claim 1, where said aperture extending axially through the center of said cylindrical body of said roller includes an inset at one axial end that provides an area to house said fastener assembly within the axial length of said roller.

16. The apparatus of claim 1, where said handle includes a bent portion.

17. The apparatus of claim 1, where the roller assembly consists essentially of a single roller, a replaceable rubber sleeve, an axle, optionally an axle sleeve, and a fastener assembly.

18. The apparatus of claim 1, where the roller assembly consists of a single roller, a replaceable rubber sleeve, an axle, optionally an axle sleeve, and a fastener assembly.

* * * * *